US009463890B2

(12) United States Patent
Mowry

(10) Patent No.: US 9,463,890 B2
(45) Date of Patent: Oct. 11, 2016

(54) VACUUM AND ULTRAVIOLET LIGHT EXPOSURE CONTAINER FOR MAINTAINING FRESHNESS OF FOOD

(71) Applicant: Eric Mowry, Leesburg, VA (US)

(72) Inventor: Eric Mowry, Leesburg, VA (US)

( * ) Notice: Subject to any disclaimer, the term of this patent is extended or adjusted under 35 U.S.C. 154(b) by 285 days.

(21) Appl. No.: 13/999,767

(22) Filed: Mar. 20, 2014

(65) Prior Publication Data

US 2015/0266598 A1 Sep. 24, 2015

(51) Int. Cl.

| | |
|---|---|
| ***B65D 81/20*** | (2006.01) |
| ***B65B 55/16*** | (2006.01) |
| ***B65B 31/02*** | (2006.01) |

(52) U.S. Cl.

CPC ..... *B65B 55/16* (2013.01); *B65B 31/02* (2013.01)

(58) Field of Classification Search

CPC ..... B65B 5/04; B65B 31/04; B65B 55/16; B65B 31/02

USPC ..... 99/468, 472; 62/3.7, 62, 78, 231; 250/455.11, 492.1

See application file for complete search history.

(56) References Cited

U.S. PATENT DOCUMENTS

| | | | | | |
|---|---|---|---|---|---|
| 2,425,816 | A * | 8/1947 | Maxson | A23L 3/28 | 141/82 |
| 4,065,857 | A * | 1/1978 | Nelson | F26B 21/004 | 34/197 |
| 5,211,808 | A * | 5/1993 | Vilardi | B04B 5/0414 | 159/16.1 |
| 5,946,919 | A * | 9/1999 | McKinney | A21C 15/00 | 62/169 |
| 5,964,255 | A * | 10/1999 | Schmidt | B65B 31/047 | 141/65 |
| 6,971,418 | B2 * | 12/2005 | De Costa | A47J 47/10 | 141/198 |
| 7,325,409 | B2 * | 2/2008 | Espinosa | A47F 3/001 | 62/169 |
| 2004/0052702 | A1 * | 3/2004 | Shuman | A23L 3/003 | 422/208 |
| 2006/0090427 | A1 * | 5/2006 | Hau | B65B 31/046 | 53/512 |
| 2009/0272279 | A1 * | 11/2009 | Kieck | A47J 47/12 | 99/468 |

* cited by examiner

*Primary Examiner* — Thien S Tran

(74) *Attorney, Agent, or Firm* — Integrity Patent Group, PLC

(57) ABSTRACT

The Stay Fresh appliance maintains food freshness by using a vacuum motor to remove the air from inside the interior of the unit or by the external vacuum opening for bags and containers. It uses the vacuum process and a UV light to kill all bacteria inside the unit to prevent bacteria from growing. The unit needs no refrigeration and can keep food fresher much longer and make more room for the refrigerator.

3 Claims, 5 Drawing Sheets

VACUUM AND ULTRAVIOLET LIGHT EXPOSURE CONTAINER FOR MAINTAINING FRESHNESS OF FOOD

There is no federally sponsored or research or development associated with this application. There is no joint research agreement associated with this application.

BACKGROUND OF THE INVENTION (1) Field of the Invention

The Stay Fresh is a new concept in maintaining food freshness without refrigeration.

(2) Description of the Art Including Information Disclosed Under 37 CFR 1.97 & 1.98

The art described in the drawings of the design and utility function illustrate the unique ability of the Stay Fresh to maintain food freshness without refrigeration and we did not find any conflicting art or patents in our patent search process.

BRIEF SUMMARY OF THE INVENTION

The Stay Fresh is an electrical appliance that maintains food freshness with no refrigeration required. It uses a vacuum system that pulls the air out the unit and uses a UV light to sterilize the unit so that bacteria does not grow inside the unit.

BRIEF DESCRIPTION OF THE SEVERAL VIEWS OF THE DRAWINGS

There are 5 drawings in total that describe and illustrate the design and function of the Stay Fresh. The broken lines are a part of this patent specification and are intended to illustrate those interior views.

DETAILED DESCRIPTION OF THE PREFERRED EMBODIMENT

The broken lines are a part of this patent specification and are intended to illustrate those interior views.

Figure 1:
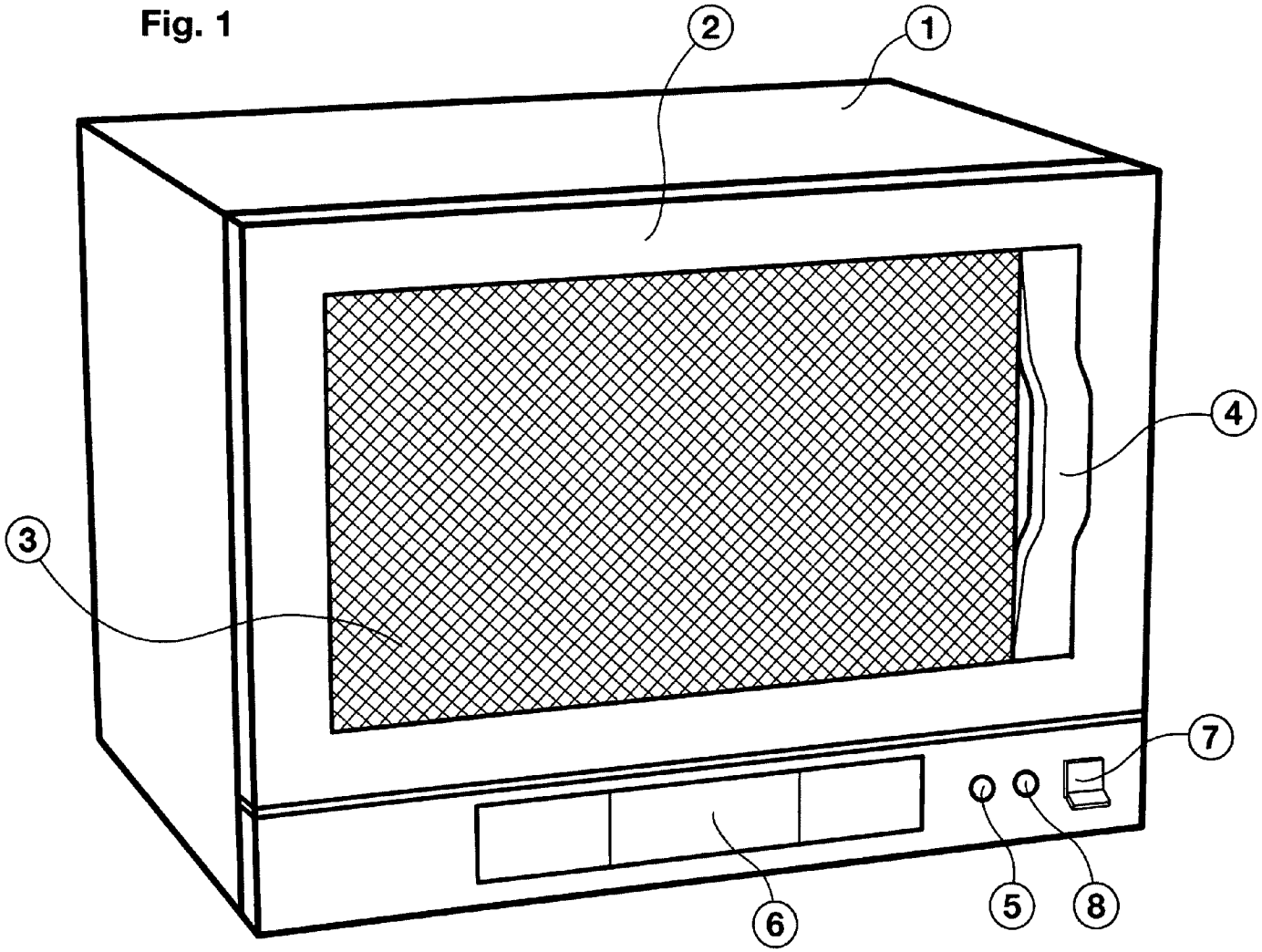
FIG. 1: is the front side angle view of the invention.

FIG. 1: In illustration #1 is the main body of the unit with #2 the frame of the front door of the unit with #3 the clear glass portion of the door with thin wire as a structural support with #4 the handle of the door with #5 the decompression button to allow the door to be opened with #6 the LED screen with #7 is the external vacuum hole sealed door with #8 the activation button for the external vacuum hole.

Figure 2:
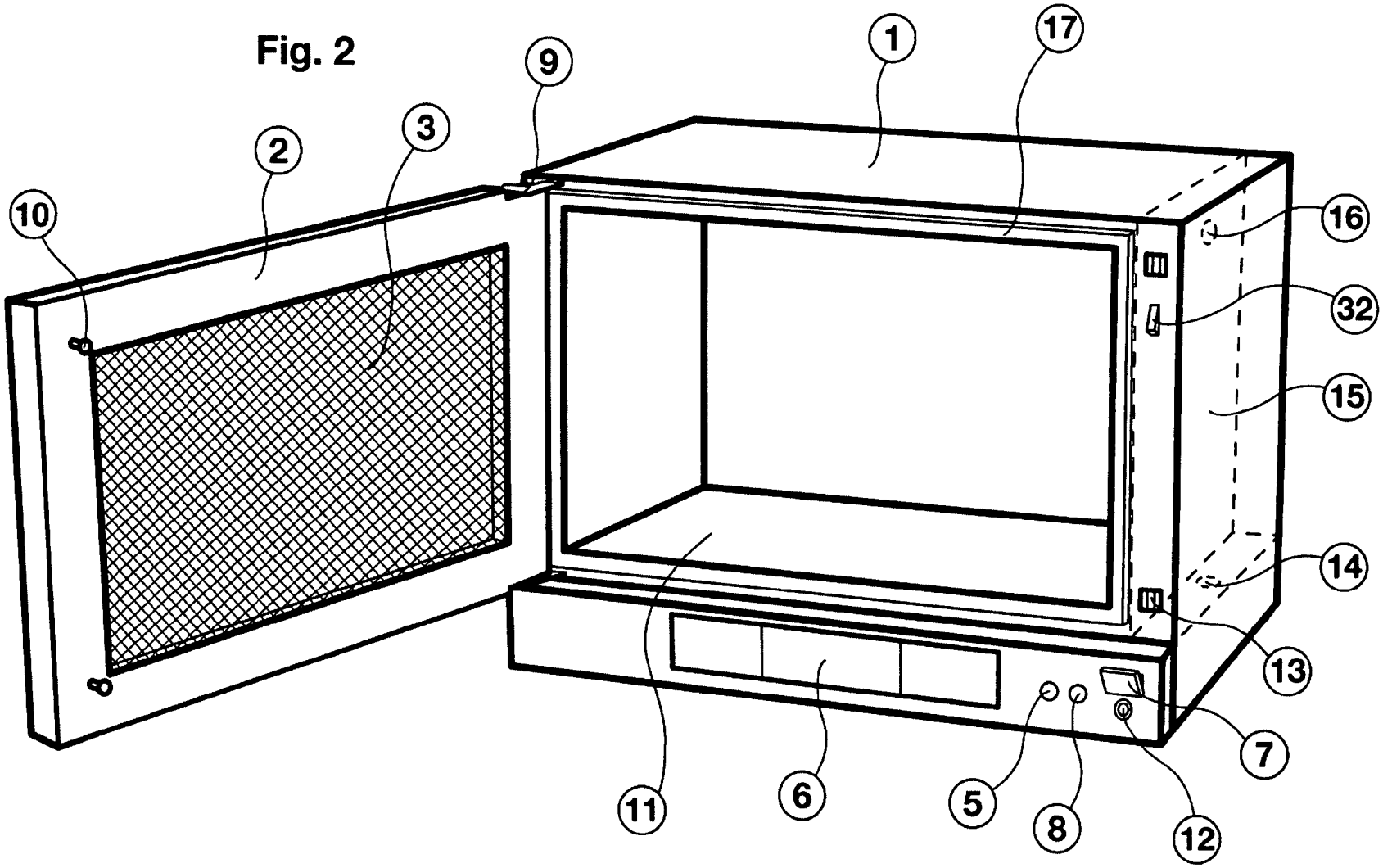
FIG. 2: is the front side view with the front door open.

FIG. 2: In illustration #1 is the main body of the unit with #2 the frame of the front door of the unit with #3 the clear glass portion of the door with thin wire as a structural support with #4 the handle of the door with #5 the decompression button to allow the door to be opened with #6 the LED or LCD screen with #7 is the external vacuum hole sealed door with #8 the activation button for the external vacuum hole with #9 the hinge for the door with #10 the clip that holds the door shut with #11 the interior of the unit with #12 the external vacuum hole with #13 the clip insert that holds the #10 clip to keep the door shut with #14 the interior view of the opening for the vacuum tube with #15 the hollow interior portion of the side that houses the vacuum tubes with #16 the interior view with the top opening for the vacuum tube with #17 the sealing strip around the front of the unit with #32 the button that activates the unit when the front door is shut.

Figure 3:
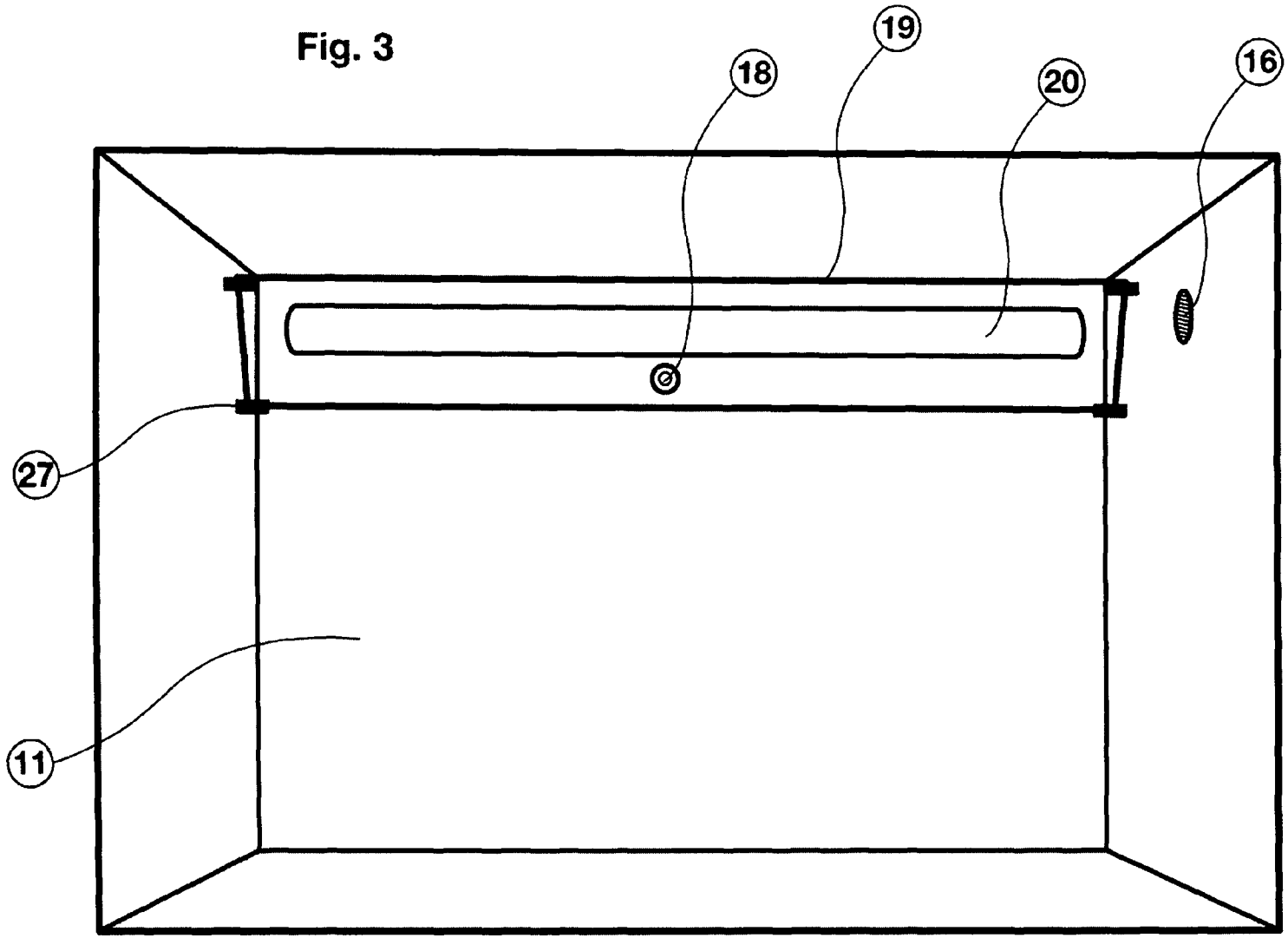
FIG. 3: is the front interior view of the unit.

FIG. 3: In illustration #11 the interior of the unit with #16 the screen for the opening of the vacuum tubing with #18 the motion sensor with #19 the glass to protect the UV light with #20 the UV light with #27 the clip that holds the frame for the glass that protects the UV light.

Figure 4:
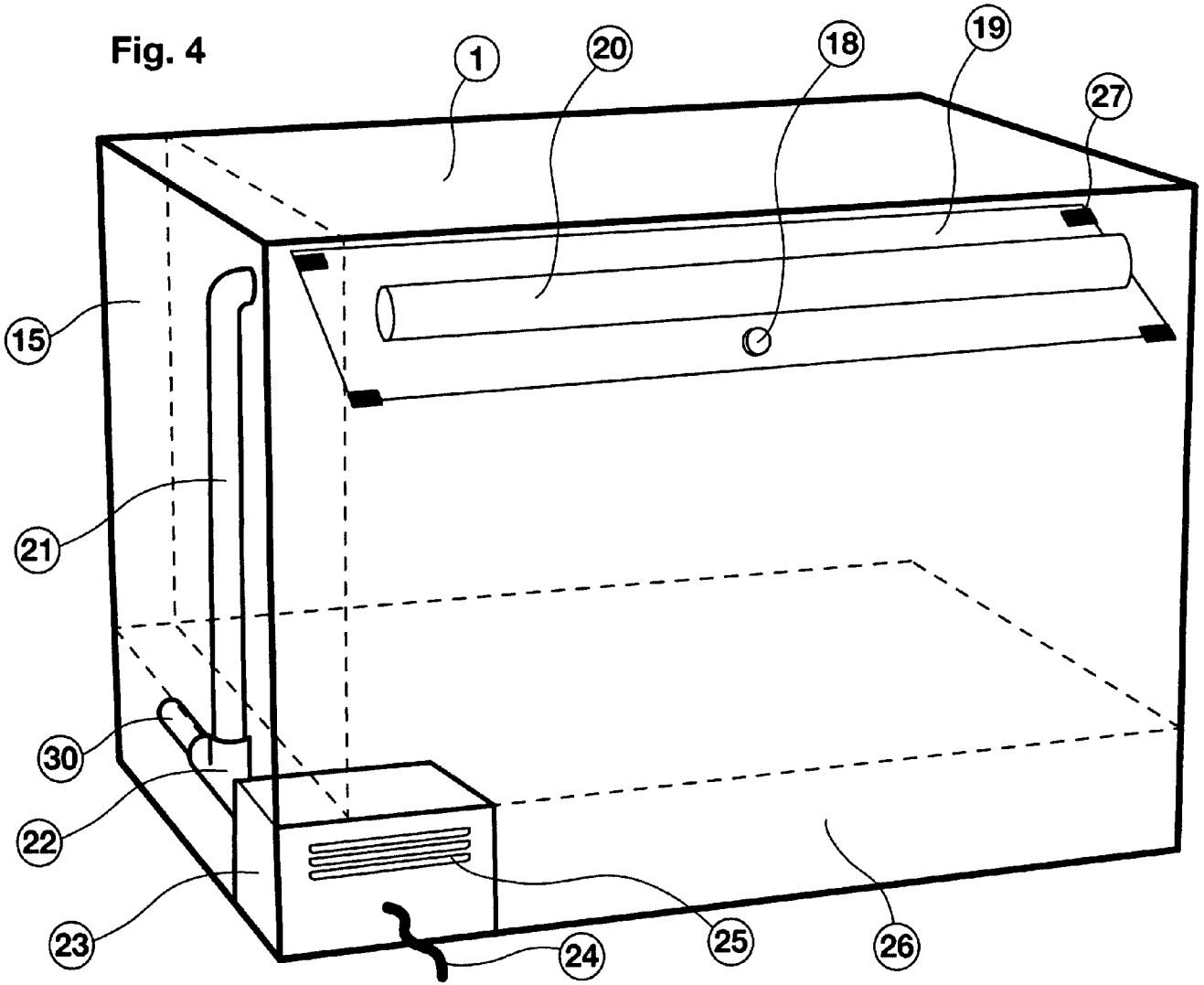
FIG. 4: is the rear internal view of the unit.

FIG. 4: In illustration #1 the main body of the unit with #15 the interior view of the hollow side that houses the vacuum tube with #18 the motion sensor with #19 the glass that protects the UV light with #20 the UV light with #21 the vacuum tube with #22 the T-connector with #23 the housing for the vacuum motor with #24 the power cord with #25 the vents to keep the vacuum motor housing cool with #26 the interior bottom hollow portion of the unit with #27 clip that holds the glass in place to protect the UV light with #30 the vacuum tube connecting to the external vacuum opening or hole.

Figure 5:
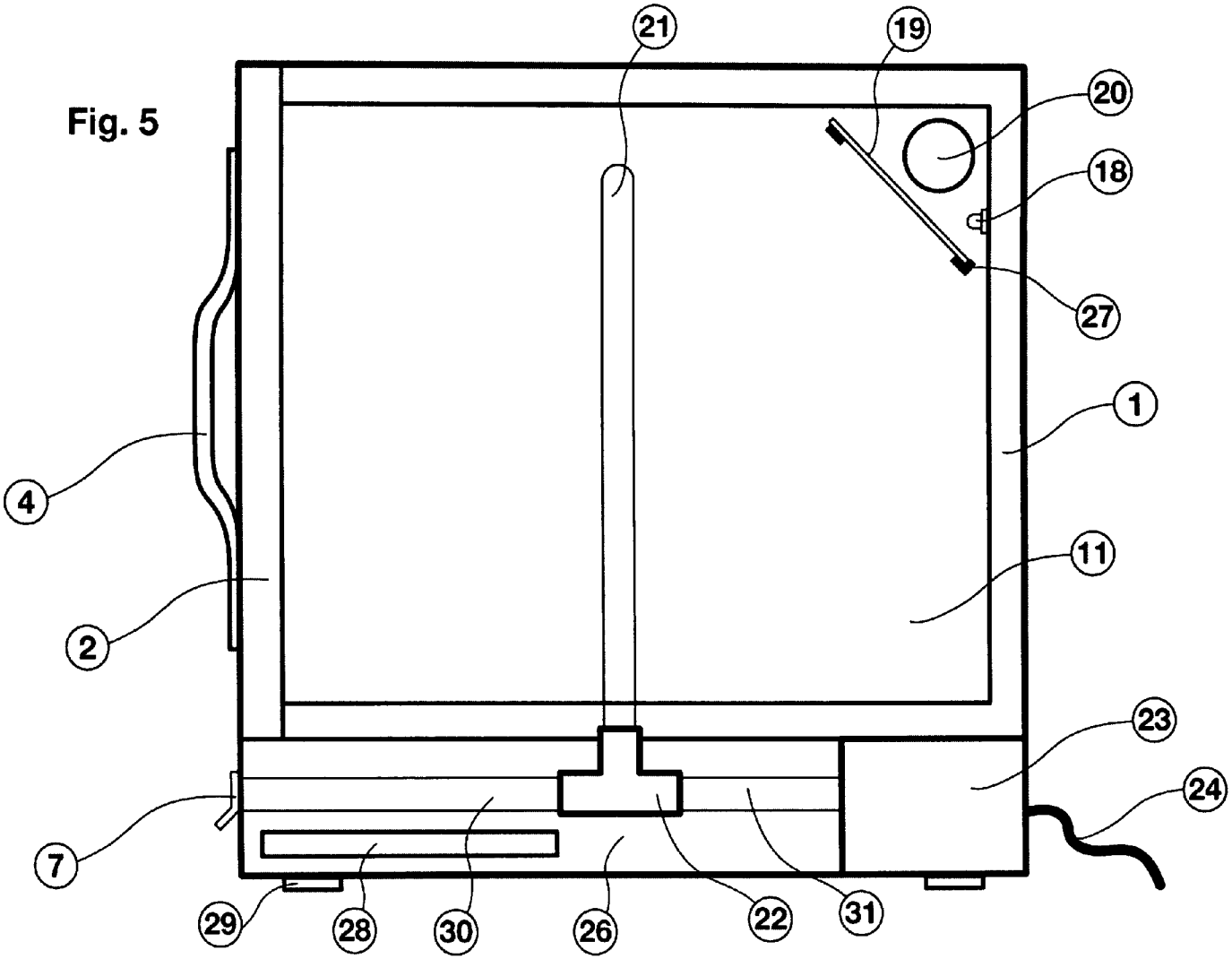
FIG. 5: is the side internal view of the unit.

FIG. 5: In Illustration #1 the main body of the unit with #2 the door of the unit with #4 the handle of the door with #7 the external vacuum opening or hole sealing door with #11 the interior of the unit with #18 the motion sensor with #19 the glass that protects the UV light with #20 the UV light with #21 the vacuum tube with #22 the T connector with #23 the vacuum motor housing with #24 the power cord with #26 the interior hollow portion of the unit with #27 the clip that holds the glass protector in place with #28 the programmable circuit board with #29 the rubber leg of the unit with #30 the vacuum tube connecting to the external vacuum opening or hole with #31 the vacuum tube from the vacuum motor to the T connector.

DETAILED DESCRIPTION OF THE INVENTION

The Stay Fresh is a new concept in maintaining food freshness for a much longer period of time than is now available with any other appliances. We all use the refrigerator for keeping our bread, fruits, vegetables, meats, and more, fresh longer than sitting it out in the air at a room temperature. This has been a cornerstone in civilization to feed the populations and to keep from going to the store every day and maintaining the nutritional value to the food and so to the consumer. If we want to keep things even longer we freeze the food. However you cannot freeze fruits or vegetables like you can meats and other types of foods.

Because the refrigerator has air on the inside of it with the door closed, the air inside is reflective of the type of climate as well. In very dry climates fruits and vegetables spoil much faster even in the refrigerator because the air is the same as the climate in which a person lives. This happens because the dry climate absorbs the moisture very quickly and cause the food to spoil quickly. In a high humidity climate the same thing can happen because it allows bacteria to grow even faster in many cases.

The freezer is always the solution to longer term freshness although it is the same air inside as the refrigerator. It may be frozen but it can get a freezer burn faster in some cases and can change the texture and flavor of the food.

To combat freezer burn or to help food last longer there is a process called vacuum packing. It is used by many people but is not a widely used process because people claim it takes too long and they do not have the time. This is also another terminology for laziness. That is the reason that the Stay Fresh could become a valued appliance in everyone's home by making it simple and easy to use and create more room in the family refrigerator.

There are two main processes used in the Stay Fresh appliance. The first is the motor that creates the vacuum by pulling the air out of the interior of the unit the same way it is done now with bags and containers and in other appliances of a similar nature. The second is the UV light used to sterilize the unit so that any bacteria is killed inside the unit and with the food stuff itself. Between those two processes it makes it possible to maintain food freshness without refrigeration. Refrigeration can dry food out and change the texture of the food and freezers can do the same thing. Having truly fresh fruit and vegetables is the most desired by consumers. This is also great for meat and this process makes the meat taste much fresher than refrigeration or certainly freezing it.

The Vacuum should be a negative from 30 kPa to 40 kPa and should take less than one minute. The UV light should be a UV-B type with a 14 second dose of light to accomplish sterilization. Both of these processes have been scientifically proven through many studies. Other types of UV are UV-A and UV-C which can also be used in the same way.

The unit can be different sizes and shapes. The Stay Fresh unit has a front door with a handle on the right side similar to other products with a pressure resistant glass with wire mesh to add strength and to have a reflective sheen on the inside of the glass to make the motion sensor more efficient. The motion sensor is in place to make sure that there are no living things inside the unit when the door is closed. When there is any motion the sensor will shut the unit off and allow air inside the unit from the vacuum motor assembly. When the door is shut it activates a button which turns the unit on and the vacuum motor pulls the air with the UV light on at the same time. The vacuum motor will activate again when the pressure has gone down and will bring the negative pressure back up to the normal level.

The unit also has an external vacuum opening to use with bags and containers. There is a decompression button on the bottom right of the unit that when pressed releases the pressure so that the door can be opened and allows the sealed cover over the external opening. When the cover is placed over the opening the door is opened and closed again and the unit will re-sterilize and re-compress. The UV light has a glass cover to help protect it from damage and works with the light and its effectiveness. The motion sensor is placed just under the UV light. The vacuum tubing runs from the hollow portion on the side of the unit and one portion of the tube runs up to the ceiling of the unit and the other portion runs to the external opening. The unit is designed to be manufactured and used in a very specific way to ensure the unit accomplishes the task of maintaining food freshness without the need for refrigeration or freezing food. It also complies with all FDA safety regulations.

What is claimed is:

1. A vacuum and ultraviolet light exposure system comprising:

a) a main body comprising:
- i) a first re-sealable interior volume comprising:
  - (1) a wall,
  - (2) an external vacuum port/door assembly port through said wall of said main body;
  - (3) a top; and
  - (4) a rear;
- ii) a second re-sealable interior volume comprising:
  - (1) a rear side;
  - (2) a bottom;
  - (3) a right side; and
  - (4) an external vacuum port/door assembly comprising:
    - (a) a port-sealing door; and
    - (b) a second seal;

b) a door comprising;
- i) a handle;
- ii) a glass center;
- iii) a wire mesh;
- iv) a reflective material;
- v) a door-circumference;
- vii) a door-inside;
- vii) a frame comprising a solid material; and
- viii) a door-seal comprising a continuous sealing strip;

c) a vacuum motor assembly comprising:
- i) a two-phase sealed vacuum motor comprising a casing structured and arranged with openings in said casing;
- ii) a vacuum tube; and
- iii) a T-connector;

d) a programmable circuit board;

e) a first-button;

f) a second-button;

g) a top-mounted UV light assembly comprising:
- i) a UV light; and
- ii) a protective glass shield comprising:
  - (1) two ends;
  - (2) a back side; and
  - (3) an edge;
- iii) two clips;

h) a motion sensor;

i) a lighted screen; and j) a vacuum bag k) wherein said port-sealing door is structured and arranged for covering said external vacuum port/door assembly port;

l) wherein said vacuum bag is structured and arranged for containing an UV sterilized and vacuum sealed food product;

m) wherein said first re-sealable interior volume is structured and arranged for the UV-vacuum-processing food product;

n) wherein said second seal is structured and arranged for removably vacuum-sealing said external vacuum port/door assembly port and further structured and arranged for to enable said external vacuum port/door assembly port for use with said vacuum bag;

o) wherein said second re-sealable interior volume is structured and arranged for enabling evacuating air from within said first re-sealable interior volume;

p) wherein said glass center is structured and arranged to withstand a differential pressure of room pressure on a side-exterior to said system and a vacuum on a side-interior to said system;

q) wherein said wire mesh is structured and arranged to structurally support said glass center;

r) wherein said reflective material is optically structured and arranged so as to be transparent from a side-exterior to said vacuum and ultraviolet light exposure system and further structured and arranged to disallow a motion said motion sensor to operate based on an any motion outside of said vacuum and ultraviolet light exposure system;

s) wherein said frame is structured and arranged with no separations between said door-inside and said door-circumference;

t) wherein said door-seal is structured and arranged with for removably vacuum-sealing between said door and said main body;

u) wherein said main body, said door, and said door-seal comprise a re-sealable vacuum chamber;

v) wherein said openings are structured and arranged with said main body for securing said two-phase sealed vacuum motor to said main body;

w) wherein said two-phase sealed vacuum motor is structured and arranged at said rear bottom right side of said main body;

x) whereby enabling said vacuum motor assembly to move into a negative pressure phase and channel air from said first sealed interior volume and further enable back-filling of air into said first sealed interior volume during a re-pressurization phase when said second-button is pressed;

y) wherein said first-button is structured and arranged on said main body;

z) wherein said first-button is structured and arranged with said door said programmable circuit board and said vacuum motor assembly so that when said first-button is pressed by an operator, said door is enabled to be opened by the operator;

aa) wherein said second-button is structured and arranged on said main body adjacent to said external vacuum port/door assembly;

bb) wherein said second-button is further structured and arranged so that when said second-button is pressed by the operator, said second-button activates said two-phase sealed vacuum motor, whereby enabling evaluating said vacuum bag;

cc) wherein said UV light is structured and arranged in the top rear of said first re-sealable interior volume;

dd) wherein said is UV light is structured and arranged a short distance from the top of said first re-sealable interior volume;

ee) wherein said UV light is further structured and arranged with regard to said first re-sealable interior volume to enable said UV light to shine throughout said first re-sealable interior volume including in front of said UV light and down back of said UV light and between said back side and said edge of said protective glass shield;

ff) wherein said two clips are structured and arranged opposite said two ends of said protective glass shield, and clip-attaching said two ends of said protective glass shield to said top and said rear of said first re-sealable interior volume;

gg) whereby said protective glass shield is structured and arranged to physically protect said UV light;

hh) wherein said motion sensor is structured and arranged adjacent to and below said top-mounted UV light assembly;

ii) wherein said motion sensor is structured and arranged to sense any movement of any object within said first re-sealable interior volume; and jj) wherein said motion sensor is electrically structured and arranged with said vacuum motor assembly said programmable circuit board and said motion sensor such that when a movement of any object is sensed:

i) said two-phase sealed vacuum motor will cease operating; and ii) will said first re-sealable interior volume will back-fill by enabling ambient air into said first re-sealable interior volume;

kk) wherein said lighted screen is visually structured and arranged to visually indicate to the operator multiple status of operation of said vacuum and ultraviolet light exposure system comprising:

i) vacuum sealing mode;

ii) UV light mode for sterilizing said first re-sealable interior volume; and iii) completion of vacuum sealing and UV sterilizing process.

2. The vacuum and ultraviolet light exposure system of claim 1:

a) wherein said vacuum tube is structured and arranged horizontally from said two-phase sealed vacuum motor to said T-connector and further structured and arranged for running vertically to the top of said second sealed interior volume and then running horizontally from said T-connector to said external vacuum port/door assembly.

3. The vacuum and ultraviolet light exposure system of claim 1 wherein said programmable circuit board is electrically and mechanically structured and arranged with said first-button said second-button said motion sensor said vacuum motor assembly said top-mounted UV light assembly said lighted screen and said external vacuum port/door assembly port is re-sealably structured and arranged with said port-sealing door and further physically structured and arranged with said vacuum bag that is vacuum-connected to said vacuum motor assembly such that when the operator closes said door and sequentially presses said first-button and covers said external vacuum port/door assembly port with said port-sealing door that the operator observes:

a) UV light emanating from said top-mounted UV light assembly flooding said first re-sealable interior volume with the UV light;

b) removing of air from within a said vacuum bag that is positioned within said first re-sealable interior volume;

c) sealing of said external vacuum port/door assembly port with said port-sealing door.

* * * * *